US012654824B2

(12) United States Patent
Foster

(10) Patent No.: US 12,654,824 B2
(45) Date of Patent: Jun. 16, 2026

(54) SYSTEMS AND METHODS OF SHIP CONSTRUCTION

(71) Applicant: Abyss Defense Industries Inc., Port Hueneme, CA (US)

(72) Inventor: Ewan Foster, Port Hueneme, CA (US)

(73) Assignee: Abyss Defense Industries Inc., Port Hueneme, CA (US)

( * ) Notice: Subject to any disclaimer, the term of this patent is extended or adjusted under 35 U.S.C. 154(b) by 0 days.

(21) Appl. No.: 19/261,179

(22) Filed: Jul. 7, 2025

(65) Prior Publication Data

US 2026/0084791 A1 Mar. 26, 2026

Related U.S. Application Data

(60) Provisional application No. 63/697,213, filed on Sep. 20, 2024.

(51) Int. Cl.
*B63B 73/60* (2020.01)
*B63B 73/43* (2020.01)

(52) U.S. Cl.
CPC ..... *B63B 73/60* (2020.01); *B63B 73/43* (2020.01)

(58) Field of Classification Search
CPC ..... B25J 9/026; B25J 9/1615; B25J 9/0018; B25J 9/0075; B25J 9/16; B25J 9/1669; B25J 9/1679; B25J 11/00; B25J 11/0075; G05B 2219/32278; G05B 19/418; G05B 19/41805; B63B 73/60; B63B 73/43; B63B 73/30
USPC ..... 700/245, 247, 249
See application file for complete search history.

(56) References Cited

FOREIGN PATENT DOCUMENTS

| | | | | | |
|---|---|---|---|---|---|
| KR | 101263517 B1 | * | 5/2013 | ..... | B23K 37/0282 |
| KR | 20210074507 A | * | 6/2021 | ..... | B25J 11/005 |
| KR | 20220026125 A | * | 3/2022 | ..... | B25J 9/1664 |
| TW | 501948 B | * | 9/2002 | ..... | B25J 5/02 |

OTHER PUBLICATIONS

English translation of KR-101263517-B1 (Year: 2013).*
English translation of KR-20210074507-A (Year: 2021).*
English translation of KR-20220026125-A (Year: 2022).*
English translation of TW-501948-B (Year: 2002).*

* cited by examiner

*Primary Examiner* — Jun S Yoo
(74) *Attorney, Agent, or Firm* — Sterne, Kessler, Goldstein & Fox P.L.L.C.

(57) ABSTRACT

A system for robotic construction of a marine vessel includes a gantry and a robot interface connected to the gantry, the gantry configured to transport the robotic interface in at least two directions. A robot configured to perform a construction operation is releasably coupled to the robot interface. A robot controller is disposed on the robot and is configured to operate the robot. The robot controller remains with the robot when the robot is removed from the gantry. A controller is operably connected to the gantry and the robot interface, the controller configured to position the gantry and to attach and release the robot from the robotic interface.

7 Claims, 5 Drawing Sheets

SYSTEMS AND METHODS OF SHIP CONSTRUCTION

FIELD

The subject matter of this disclosure generally relates to systems, devices, and methods relating to the construction of ships. More specifically, this disclosure relates to manufacturing components of ships using robotic assembly-line type techniques.

BACKGROUND

This disclosure relates to the field of ship construction. Specifically, this disclosure is related to systems and methods for applying robotic assembly methods to construction of ship components.

Large marine vessels or ships are largely constructed by hand using various techniques such as welding and riveting. While smaller portions of the ships can be constructed using automated techniques, the size of the larger components and complexity of construction has typically required manual construction, such as the work of individual welders or riveters construction structural components of a ship.

This results in increased cost and time and also can introduce errors in ship building components caused by manual labor. Robotic construction technology can decrease cost and time and reduce errors. Thus, there is a need to improve ship building techniques using robotic construction technology.

BRIEF SUMMARY OF THE INVENTION

In an embodiment, a system for robotic construction of a marine vessel includes a gantry and a robot interface connected to the gantry, the gantry configured to transport the robotic interface in at least two directions. A robot configured to perform a construction operation is releasably coupled to the robot interface. A robot controller is disposed on the robot and is configured to operate the robot. The robot controller remains with the robot when the robot is removed from the gantry. A controller is operably connected to the gantry and the robot interface, the controller configured to position the gantry and to attach and release the robot from the robotic interface.

In a further embodiment, the system above includes a second robot, wherein the controller is configured to release the robot from the robot interface and attach the second robot.

In a further embodiment, the robot includes an end effector releasably coupled to the robot, wherein the robot controller is configured to use the end effector to perform the construction operation.

In a further embodiment, the robot includes a plurality of end effectors, each end effector configured to be releasably coupled to the robot, wherein the robot controller is configured to use at least one of the plurality of end effectors to perform the construction operation.

In a further embodiment, the gantry is configured to move the robot in at least three directions.

In a further embodiment, the robot includes a material handling robot; a frame attached to the material handling robot; and a welding robot attached to the frame.

In a further embodiment, the welding robot is movably attached to the frame, the robot controller operably connected to the welding robot to control movement of the welding robot.

In an embodiment, a method of robotic construction of a marine vessel, includes moving a portion of a gantry to a robot; using a robot interface on the gantry to couple the robot to the gantry; using a robot controller disposed on the robot to control the robot to perform a construction operation on the marine vessel; separating the robot from the robot interface, wherein the robot controller remains with the robot after the separation.

In a further embodiment, the method above includes attaching a second robot to the robot interface after separating the robot from the robot interface.

In a further embodiment, the method above includes using an end effector releasably coupled to the robot to perform the construction operation.

In a further embodiment, the method above includes using at least two of a plurality of end effector releasably coupled to the robot to perform the construction operation.

In a further embodiment, the gantry is configured to move the robot in at least three directions.

In a further embodiment, the robot includes a material handling robot; a frame attached to the material handling robot; and a welding robot attached to the frame; and the method further includes using the material handling robot to handle the ship component while also using the welding robot to weld the ship component.

In a further embodiment, the welding robot is movably attached to the frame, the method further including moving the welding robot during the welding.

In an embodiment, a pin jig for ship construction includes a jig base; a plurality of jacks fixed to the jig base, each of the jacks having an actuator configured to extend and retract the jack; a sensor configured to detect a position of each of the plurality of jacks; and a controller operably connected to the plurality of jacks and the sensor, the controller configured to actuate the plurality of jacks into a predetermined position based on data from the sensor.

In a further embodiment, each jack comprises a jack stop configured to prevent movement of the jack, wherein the jack stop and the actuator are independently powered.

In a further embodiment, the sensor is further configured to detect contact between each of the jacks and a work piece, and In a further embodiment, the controller is configured to actuate the jacks until each jack contacts the work piece to determine a shape of the work piece.

In an embodiment, a method of securing a ship component using a pin jig, includes actuating a plurality of jacks fixed to a jack base into a predetermined position, each of the jacks being actuated by an actuator controlled by a controller, the position of each of the jacks being sensed by a sensor; and fastening the ship component to the jacks.

In a further embodiment, the method above includes securing each jack into position using a jack stop, wherein the jack stop and the actuator are independently powered.

In a further embodiment, the method above includes detecting contact between a jack and the ship component using a contact sensor, and actuating each of the jacks until each jack contacts the work piece to determine a shape of the work piece, wherein contact between each jack and the ship component is determined using a contact sensor.

BRIEF DESCRIPTION OF THE DRAWINGS/FIGURES

The accompanying drawings, which are incorporated herein and form a part of the specification, illustrate the present disclosure and, together with the description, further serve to explain the principles thereof and to enable a person skilled in the pertinent art to make and use the same.

In the drawings, like reference numbers generally indicate identical or similar elements. Additionally, generally, the left-most digit(s) of a reference number identifies the drawing in which the reference number first appears.

DETAILED DESCRIPTION

Reference will now be made in detail to representative embodiments illustrated in the accompanying drawings. References to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such a feature, structure, or characteristic in connection with other embodiments whether or not explicitly described.

Some embodiments of the present disclosure are related to a robotic assembly cell 100 for construction of ship components. Robotic assembly cell 100 is designed to reduce assembly cost, parts count, and complexity by allow for the substitution or changing of entire assembly robots, which are able to be positioned as needed on a gantry 102.

Figure 1:
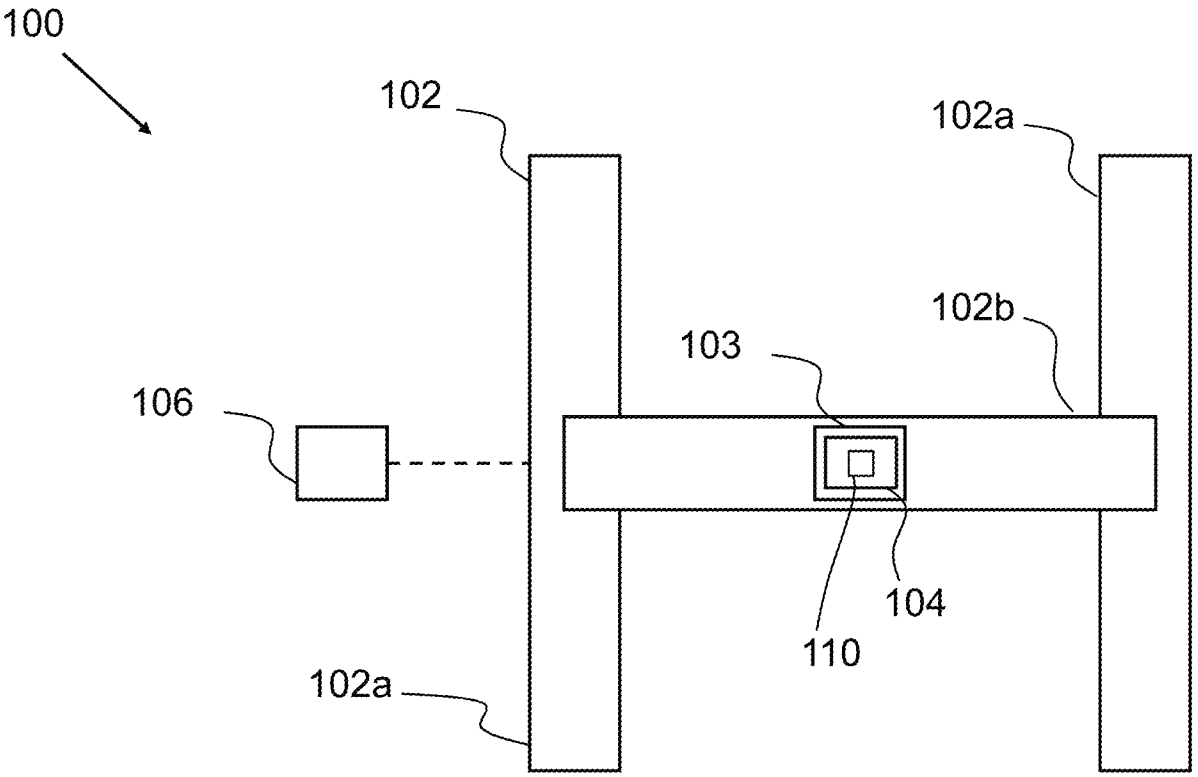
FIG. 1 is a top view diagram of a robotic gantry system for ship construction according to an embodiment.
Figure 2:
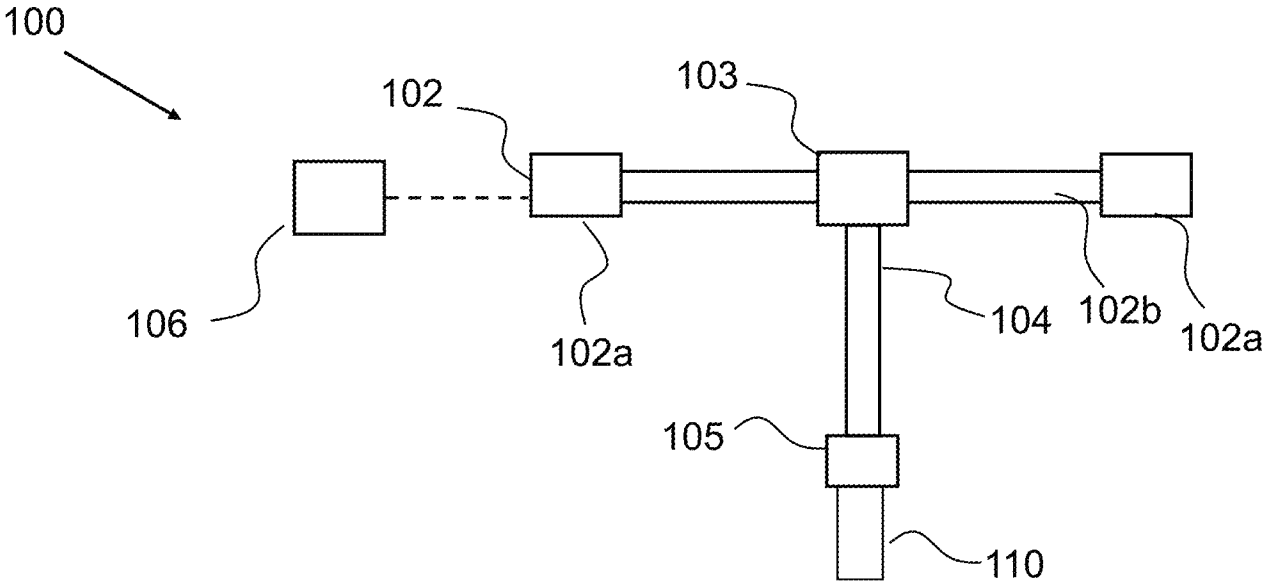
FIG. 2 is a side view diagram of a portion of a robotic gantry system for ship construction according to an embodiment.

As seen in FIGS. 1 and 2, the basic components of robotic assembly cell 100 include a robot 110 mounted to a gantry 102. In some embodiments, gantry 102 is a multi-axis overhead gantry of sufficient payload to transport robot 110, associated support structure and control electronics, and payload 112 of robot 110. In some embodiments, as seen in FIG. 2, gantry 102 can be a three-axis gantry comprising a first track 102*a* and a second track 102*b* movably mounted to first track 102*a*. A platform 103 is movably mounted to second track 102*b*, which gives platform 103 the ability to be positioned in two directions, for example the x and y horizontal directions, as desired. Platform 103 is the base for a vertical actuator 104 that can move a gantry load interface 105 fixed to vertical actuator 104 in a third vertical direction with respect to the plane defined by first track 102*a* and second track 102*b*. This allows for three-dimensional positioning of gantry load interface 105 within the range of motion of gantry 102. In some embodiments gantry 102 may allow for more or less directions of motion of gantry load interface 105. The movement of the components of gantry 102 is controlled by a manufacturing controller 106 that is operably connected to the actuators and sensors of gantry 102. Manufacturing controller 106 can include a processor and memory that are operably connected to sensors 108 that are configured to detect the position of each component of gantry 102. This allows manufacturing controller 106 to position and move gantry 102 as needed to accomplish manufacturing assembly operations.

Gantry load interface 105 is intended to releasably couple robot 110 to gantry 102. In some embodiments, gantry load interface 105 is configured to rapidly and securely capture a corresponding robot interface 111 that is fixed to robot 110. Gantry load interface 105 has sufficient capacity to secure both robot 110 and payload 112. Gantry load interface 105 can be automated and controlled by manufacturing controller 106 for the coupling and decoupling process with robot 110.

Figure 3:
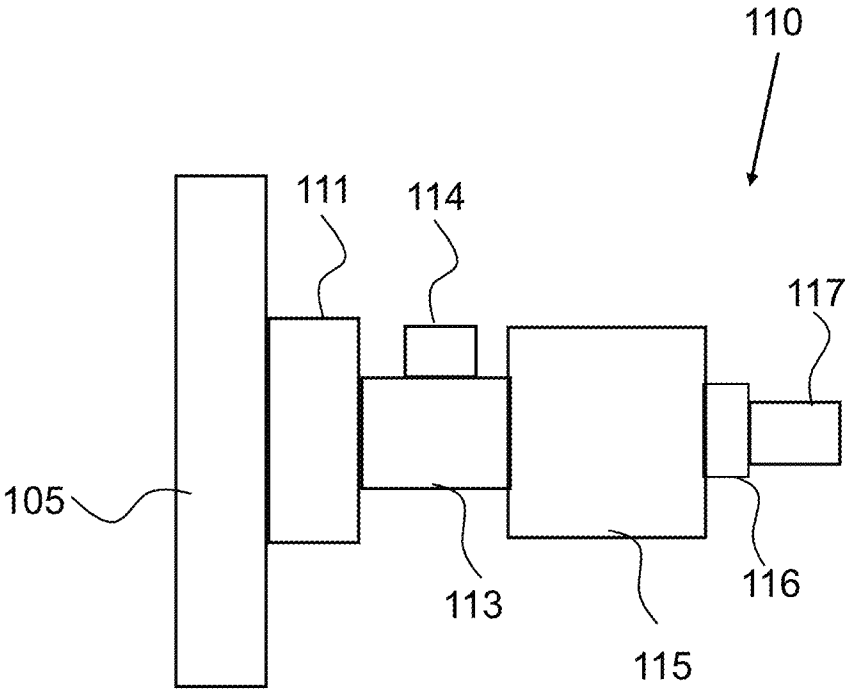
FIG. 3 is a diagram of a robot for ship construction according to an embodiment.

Robot 110 can be any suitable robot for manufacturing. Examples of manufacturing robots include robots capable of welding, performing machining operations (e.g., drilling, cutting), performing fastening operations (e.g., riveting, fastening nuts or bolts), performing shaping operations (e.g., metal bending or shaping), and other manufacturing steps. Each robot 110 will have robot interface 111 that can be securely coupled to gantry interface 104 as discussed above. As seen in FIG. 3, robot 110 is fixed to robot interface 111 through a robot base 113 that is a suitable support structure for the remainder of robot 110. Robot 110 will also have a robot control 114, which is a controller that controls the electronic operation of robot 110. In some embodiments robot control 114 is fixed to robot base 113. This provides the benefit of allowing robot control 114 to remain connected to robot 110 at all times, even when robot 110 is being changed out from gantry 102. Disconnecting robot control 114 from robot 110 requires time and is a relatively complex task that often requires steps such as recalibration of robot 110 after completion. Thus, keeping robot control 114 connected to robot 110 saves time and reduces the chances of damage to robot 110.

Robot 110 also includes a robot mechanism 115 that houses the various actuators and electromechanical elements that enable robot 110 to function as required. An end effector interface 116 is mounted to robot mechanism 115 to allow for the use of one or more end effectors 117. These end effectors 117 are the tools robot 110 uses to perform its function. More than one end effector 117 may be stored on robot 110 and can be changed over by the use of end effector interface 116, which releasably connects to the end effectors. Examples of end effectors on various robots 110 can be welding tips, riveting tools, fastening tools such as nut sockets or screwdriver tips, handling tools such as magnets or vacuum attachments, sensors (e.g., cameras, laser, eddy current, and paint thickness sensors), abrasive grinding tools, cutting tools such as drills or milling heads, media blasting tools, blast media retrieval tools, and laser ablation tools. Also present on robot 110 are suitable sensors and actuators to use the tools discussed above to perform assembly operations.

In use a plurality of robots 110 can be stored in ready condition in an area accessible by gantry 102. Each robot 110 can be configured to perform a different construction function. During construction gantry 102 maneuvers gantry load interface 105 to the robot 110 required for a given assembly step and attaches that robot 110 to gantry 102. Once the operation of that robot 110 is completed, a different robot 110 can be substituted in the same manner to enable a continuous work flow on the ship component. It should be understood that there can be multiple gantries 102 that each employ different robots 110 while working on the same ship component.

Figure 4:
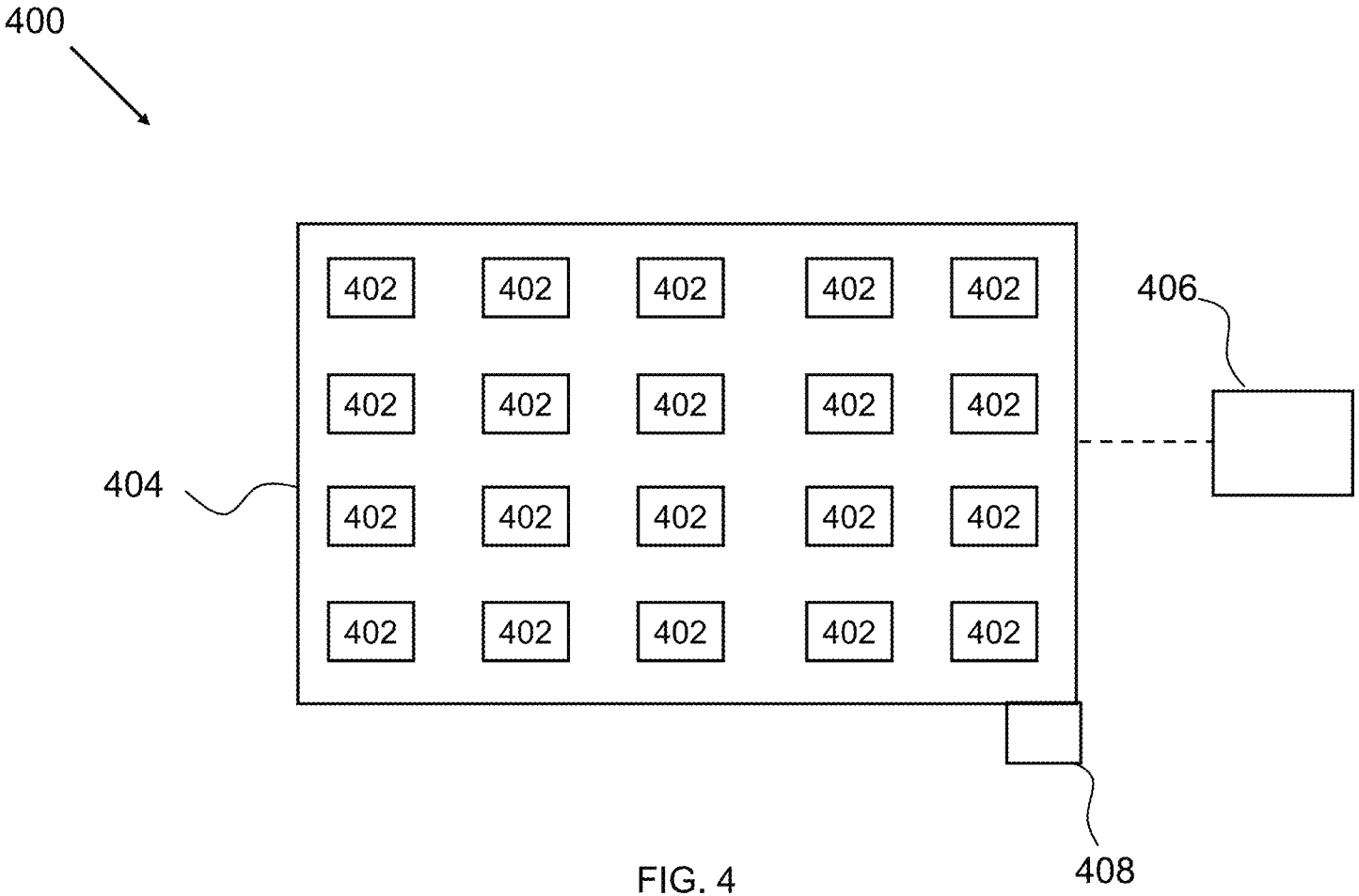
FIG. 4 is a top view diagram of a pin jig for ship construction according to an embodiment.

FIG. 4 shows an embodiment of an adjustable pin jig 400 that can be used to hold a ship component in a desired shape. Pin jig 400 comprises an array of adjustable jacks 402 fixed to a flat base 404 that can be used to hold a flexible sheet of metal (or other suitable material) in a predetermined shape. Each jack 402 is operably connected to a pin jig controller 406 that can control the position of jack 402. In this way controller 406 can actuate each jack 402 as needed to form pin jig 400 to the desired shape. The component can then be placed on and fastened to pin jig 400 into the desired shape. In some embodiments, controller 406 can receive input in the form of a pre-made CAD model with the desired shape, which can then be used to control jacks 402. In other embodiments each jack 402 can have its position manually input into controller 406.

Jacks 402 can be electric actuators or hydraulically actuated. In some embodiment there can be independent jack locks used to lock and unlock jack 402 in a position and to actuate jack 402. This can improve safety and performance by reducing the likelihood of a single failure resulting in movement of jack 402. Suitable sensors 408 can be positioned to determine the positions of each jack 402. Sensors 408 can be placed internally to each jack 402 (e.g., as a position encoder) or externally, as a camera or other optical type position determination.

In addition to be used to secure pieces for construction purposes, pin jig 400 can also be used to inspect completed pieces to determine their shape. This is accomplished by placing a finished or partially finished component onto pin jig 400 and then advancing each jack 402 until it contacts the piece. In some embodiments this contact can be sensed by sensors 408 discussed above. In other embodiments specific additional sensors 408 may be added to pin jig 400, such as electric contact sensors. Once contact is made the position of each jack 402 is recorded by controller 406 and can be compared to the predetermined positions to determine if the shape of the completed piece is correct. Note that this process can also occur during shaping steps to gauge the progress of the completion of a work piece.

Figure 5:
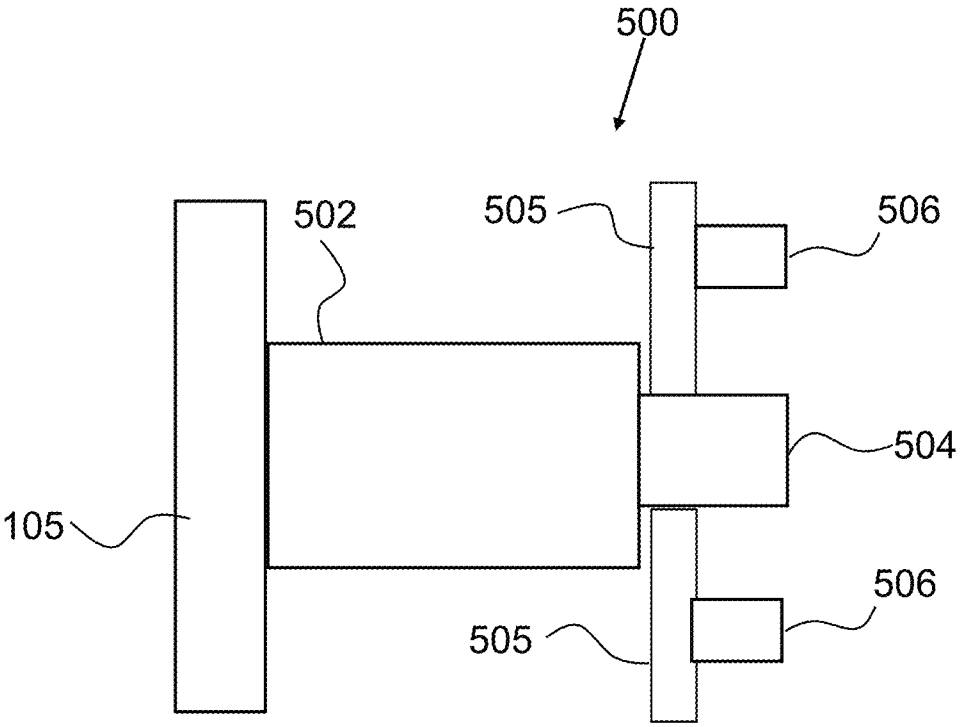
FIG. 5 is a diagram of a robot for ship construction according to an embodiment.

FIG. 5 shows an embodiment of a robot 500 that combines material handling and welding capabilities. As discussed above, robots 110 can perform multiple functions, including welding. One part of welding is holding the elements to be welded in the appropriate relative positions during welding. This can be difficult in the ship building context because the pieces to be welded are often large and heavy, and access to secure the pieces can be complicated by ship geometries where space can be minimal. Robot 500 aims to solve these problems by presenting a combined material handling and welding robot. The basis for robot 500 is a handling robot 502 that includes end effectors 504 suitable for holding large elements such as hull plates using suitable techniques, such as magnet or a vacuum. One or more additional welding robots 506 are attached to a frame 505 secured to robot 502. These welding robots 506 can perform the welding operations needed once robot 502 secures the relevant components in position. In some embodiments welding robots 506 can be movable on suitable tracks or arms secured to robot 502 to improve welding performance. In this way robot 500 can perform welding operations of large components without requiring additional external support to either weld the components or position the components for welding.

What is claimed is:

1. A system for robotic construction of a marine vessel, comprising:

a gantry;

a robot interface connected to the gantry, the gantry configured to transport the robot interface in at least two directions;

a robot configured to perform a construction operation releasably coupled to the robot interface;

a robot controller disposed on the robot and configured to operate the robot, wherein the robot controller remains with the robot when the robot is removed from the gantry; and a controller operably connected to the gantry and the robot interface, the controller configured to position the gantry and to attach and release the robot from the robotic interface.

2. The system of claim 1, further comprising a second robot, wherein the controller is configured to release the robot from the robot interface and attach the second robot.

3. The system of claim 1, wherein the robot comprises an end effector releasably coupled to the robot, wherein the robot controller is configured to use the end effector to perform the construction operation.

4. The system of claim 1, wherein the robot comprises a plurality of end effectors, each end effector configured to be releasably coupled to the robot, wherein the robot controller is configured to use at least one of the plurality of end effectors to perform the construction operation.

5. The system of claim 1, wherein the gantry is configured to move the robot in at least three directions.

6. The system of claim 1, wherein the robot further comprises:

a material handling robot;

a frame attached to the material handling robot; and a welding robot attached to the frame.

7. The system of claim 6, wherein the welding robot is movably attached to the frame, the robot controller operably connected to the welding robot to control movement of the welding robot.

* * * * *